US008871416B2

(12) United States Patent
Saito et al.

(10) Patent No.: US 8,871,416 B2
(45) Date of Patent: Oct. 28, 2014

(54) ELECTROSTATIC CHARGE IMAGE DEVELOPING TONER, ELECTROSTATIC CHARGE IMAGE DEVELOPER, TONER CARTRIDGE, DEVELOPER CARTRIDGE, PROCESS CARTRIDGE, IMAGE FORMING METHOD, AND IMAGE FORMING APPARATUS

(75) Inventors: Yutaka Saito, Kanagawa (JP); Hiroki Ohmori, Kanagawa (JP); Hirokazu Hamano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 121 days.

(21) Appl. No.: 13/562,840

(22) Filed: Jul. 31, 2012

(65) Prior Publication Data

US 2013/0244161 A1 Sep. 19, 2013

(30) Foreign Application Priority Data

Mar. 14, 2012 (JP) ..... 2012-056940

(51) Int. Cl.
*G03G 9/08* (2006.01)

(52) U.S. Cl.
USPC ..... 430/108.6; 430/108.7; 430/125.3; 399/111; 399/121; 399/297

(58) Field of Classification Search
CPC ..... G03G 9/09708; G03G 9/09716; G03G 21/1853; G03G 2221/1654; G03G 2221/183; G03G 2221/1642; G03G 21/16; G03G 15/1605; G03G 15/161; G03G 2215/0119
USPC ..... 430/108.6, 108.7, 125.3; 399/111, 121, 399/297
See application file for complete search history.

(56) References Cited

U.S. PATENT DOCUMENTS

| | | | | |
|---|---|---|---|---|
| 2009/0239171 | A1 | 9/2009 | Anno et al. | |
| 2010/0009282 | A1 | 1/2010 | Katoh et al. | |
| 2011/0136054 | A1* | 6/2011 | Watanabe et al. | 430/108.6 |
| 2012/0156602 | A1* | 6/2012 | Yamazaki et al. | 430/105 |
| 2012/0156603 | A1* | 6/2012 | Kunii et al. | 430/105 |

FOREIGN PATENT DOCUMENTS

| | | | | |
|---|---|---|---|---|
| JP | A-2009-258681 | | 11/2009 | |
| JP | A-2010-20024 | | 1/2010 | |
| JP | 2011118210 | * | 6/2011 | G03G 9/08 |

OTHER PUBLICATIONS

Machine English language translation of JP 2011118210, Jun. 2011.*

* cited by examiner

*Primary Examiner* — Hoa V Le
(74) *Attorney, Agent, or Firm* — Oliff PLC

(57) ABSTRACT

An electrostatic charge image developing toner includes toner particles containing a colorant, a binder resin, and a release agent, and an external additive, wherein the external additive includes particles having oil-treated surfaces and composite particles containing silica and titania, and the toner has a content ratio of titania with respect to silica on the surface of the toner, as measured by X-ray photoelectron spectroscopy, of equal to or less than 5 atomic %.

18 Claims, No Drawings

ELECTROSTATIC CHARGE IMAGE DEVELOPING TONER, ELECTROSTATIC CHARGE IMAGE DEVELOPER, TONER CARTRIDGE, DEVELOPER CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2012-056940 filed Mar. 14, 2012.

BACKGROUND

1. Technical Field

The present invention relates to an electrostatic charge image developing toner, an electrostatic charge image developer, a toner cartridge, a developer cartridge, a process cartridge, an image forming method, and an image forming apparatus.

2. Related Art

A method for visualizing image information via an electrostatic charge image, such as electrophotography, is currently used in a variety of fields. In electrophotography, an electrostatic charge image (electrostatic latent image) is formed on a photoreceptor (image holding member) by charging and exposure, and the electrostatic latent image is visualized by developing by a developer containing a toner, transferring, and fixing. The developer used in this development includes a two-component developer containing a toner and a carrier, and a single-component developer using a magnetic toner or non-magnetic toner singly. Here, as a preparation method for the toner, a kneading pulverizing preparation method in which a thermoplastic resin is molten-kneaded with a pigment, a charge control agent, or a release agent such as a wax, and cooled, and then the mixture is finely pulverized and then classified, is usually used. For these toners, inorganic or organic particles for improving the fluidity or cleaning property may be added to the surface of the toner particles, if desired, in some cases.

SUMMARY

According to an aspect of the invention, there is provided an electrostatic charge image developing toner, including toner particles containing a colorant, a binder resin, and a release agent, and an external additive, wherein the external additive includes particles having oil-treated surfaces and composite particles containing silica and titania, and the toner has a content ratio of titania with respect to silica on the surface of the toner, as measured by X-ray photoelectron spectroscopy, of equal to or less than 5 atomic %.

DETAILED DESCRIPTION

Hereinbelow, the present exemplary embodiments will be described.

Toner for Developing Electrostatic Charge Image

The electrostatic charge image developing toner of the present exemplary embodiment (which will also be hereinafter simply referred to as a "toner") includes toner particles and an external additive that is externally added to the toner particles, wherein the external additive contains particles having oil-treated surfaces and composite particles containing silica and titania, and the content ratio of titania with respect to silica on the outermost surface of the toner, as measured by X-ray photoelectron spectroscopy, is equal to or less than 5 atomic %.

Since titania has low-resistance, it has excellent charge exchanging properties, and thus, can maintain a sharp charge distribution over a long period of time. However, titania has a high specific gravity and a high Mohs hardness, and accordingly, it easily polishes a photoreceptor, and color streaks in the image due to damage are generated. On the other hand, by using an oil-treated external additive, the oil coated on the photoreceptor increases the lubricity of titania and the photoreceptor deposited on the cleaning blade part. By this, abrasion of the photoreceptor is suppressed to prevent the damage, and the generation of color streaks is suppressed. However, the present inventors have found that since the oil easily absorbs water under a high temperature and high humidity environment, water adsorbed onto the oil further decreases the resistivity of the titania that is originally low in the case where the oil is coated on titania present on the surface of the toner by stirring-stress in a developing device, the leakage of charge thus occurs, and the charging is reduced, and as a result, density variation occurs particularly under a high temperature and high humidity environment.

The present inventors have made extensive studies, and as a result, they have found that by using composite particles containing silica and titania and particles having oil-treated surfaces concurrently as an external additive of a toner, and further, setting the content ratio of titania with respect to silica on the outermost surface of the toner, as measured by X-ray photoelectron spectroscopy, at equal to or less than 5 atomic %, the charge exchanging properties of titania are maintained and color streaks due to damage are not generated, and even when oil is coated, since silica with high resistivity is present on the surface of the titania, reduction in the resistivity due to the adsorbed water may be suppressed and density variation may be prevented even under a high temperature and high humidity environment.

Hereinafter, the respective components constituting the toner and the values of physical properties will be described.

Content Ratio of Titania with Respect to Silica on Outermost Surface of Toner, as Measured by X-Ray Photoelectron Spectroscopy The content ratio of titania with respect to silica on the outermost surface of the toner, as measured by X-ray photoelectron spectroscopy, of the toner of the present exemplary embodiment is equal to or less than 5 atomic %, preferably 0.1 atomic % to 5 atomic %, more preferably 0.2 atomic % to 5 atomic %, and still more preferably 0.3 atomic % to 4.5 atomic %. In the exemplary embodiment, the generation of color streaks is reduced, and an image having reduced fogging may be obtained under a high temperature and high humidity environment.

The method for measuring the content ratio of titania with respect to silica on the outermost surface of the toner using X-ray photoelectron spectroscopy (XPS) is not particularly limited as long as it is an X-ray photoelectron spectroscopic method, but specifically, the content ratio is measured by carrying out XPS measurement using an X-ray photoelectron spectroscopy device (JPS9000MX, manufactured by JEOL Ltd.) under the measurement conditions of an acceleration voltage of 10 kV and a current value of 30 mA.

Content of Titania with Respect to Silica in Entire Toner

In the toner of the present exemplary embodiment, the content of titania with respect to silica in the entire toner is preferably from 5% by weight to 60% by weight, and more preferably from 10% by weight to 50% by weight. Within these ranges, an image having excellent charging properties and reduced fogging may be obtained even under a high temperature and high humidity environment.

Preferred examples of the method for measuring the content of titania with respect to silica in the entire toner include fluorescent X-ray analysis.

Specifically, the Net intensity with the fluorescent X-rays is measured using a toner with the addition of various amounts of each of silica and titania, and a calibration curve of the Net intensity with the fluorescent X-rays with respect to the addition amounts of the elemental Si and the elemental Ti is prepared. The toner with external addition is subjected to a measurement using fluorescent X-rays, and the content of titania with respect to silica in the entire toner is measured using the calibration curve from the Net intensity of the elemental Si and the elemental Ti.

External Additive

The toner of the present exemplary embodiment contains an external additive that is externally added to the toner particles, wherein the external additive contains particles having oil-treated surfaces and composite particles containing silica and titania.

The toner of the present exemplary embodiment may contain one kind or two or more kinds of particles having oil-treated surfaces and composite particles containing silica and titania. Further, the toner of the present exemplary embodiment may contain external additives other than the particles having oil-treated surfaces and the composite particles containing silica and titania.

Examples of the method for externally adding the external additive in the toner of the present exemplary embodiment include a method in which toner particles and an external additive are mixed using, for example, a Henschel mixer or a V blender for preparation. Further, when the toner particles are prepared by a wet method, the external additive may be externally added by a wet method.

Particles Having Oil-Treated Surfaces

The toner of the present exemplary embodiment includes particles having oil-treated surfaces as an external additive. By incorporating the particles having oil-treated surfaces as the external additive, the generation of color streaks in the obtained image is suppressed.

Examples of the oil in the particles having oil-treated surfaces include a silicone oil, an aliphatic amide, and a wax. Further, as the oil, a known lubricant is also used. Among these, the silicone oil is preferred.

Examples of the silicone oil include organosiloxane oligomers; cyclic compounds such as octamethylcyclotetrasiloxane, or decamethylcyclopentasiloxane, tetramethylcyclotetrasiloxane, and tetravinyltetramethylcyclotetrasiloxane; and linear or branched organosiloxanes.

Among the silicone oils, from the viewpoints that oil is easily fixed and adhered on the surfaces of the silicon oxide particles and the amount of the free oil is easily set in a predetermined range, methylphenylsilicone oil, dimethylsilicone oil, alkyl-modified silicone oil, amino-modified silicone oil, and alkoxy-modified silicone oil are preferred; dimethylsilicone oil, amino-modified silicone oil, and alkoxy-modified silicone oil are more preferred; and dimethylsilicone oil is particularly preferred.

Examples of the aliphatic amides include oleic acid amide, erucic acid amide, ricinoleic acid amide, and stearic acid amide.

Examples of the waxes include vegetable waxes such as carnauba wax, rice wax, candelilla wax, wood wax, and jojoba oil; animal waxes such as beeswax; mineral waxes such as montan wax, ozokerite, ceresin, paraffin wax, microcrystalline wax, and Fischer-Tropsch wax; petroleum wax; and modified products thereof.

From the viewpoint that it is easy to adhere the oil uniformly on the surfaces of the particles, the viscosity of the oil is preferably equal to or less than $5.0\times10^{-4}$ $m^2/s$ (500 centistokes), more preferably equal to or less than $3.0\times10^{-4}$ $m^2/s$ (300 centistokes), and still more preferably equal to or less than $2.0\times10^{-4}$ $cm^2/s$ (200 centistokes).

The particles in the particles having oil-treated surfaces are not particularly limited, and as the external additive of the toner, known inorganic particles and organic particles are used, examples of which include inorganic particles such as silica, alumina, titanium oxide (for example, titanium oxide and metatitanic acid), cerium oxide, zirconia, calcium carbonate, magnesium carbonate, calcium phosphate, and carbon black; and resin particles such as vinyl resins, polyester resins, and silicone resins.

Among these, silica particles or titanium oxide particles are preferred, and silica particles are particularly preferred.

Examples of the silica particles include silica particles of fumed silica, colloidal silica, silica gel, or the like.

Furthermore, as long as the particles have oil on the surfaces, for example, they may have been subjected to a hydrophobization treatment with a silane coupling agent as described later, or the like.

The hydrophobization treatment may be carried out by, for example, dipping the inorganic particles in a hydrophobizing agent. The hydrophobizing agent is not particularly limited, but examples thereof include a silane coupling agent, a titanate coupling agent, and an aluminum coupling agent. These may be used singly or in combination of two or more kinds thereof. Among these, a silane coupling agent may be preferred.

The silane coupling agent of any type of, for example, chlorosilane, alkoxysilane, silazane, and a specific silylating agent may be used.

Specific examples of the silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltriethoxysilane, decyltrimethoxysilane, hexamethyldisilazane, N,O-(bistrimethylsilyl) acetoamide, N,N-(trimethylsilyl) urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

Although the amount of the hydrophobizing agent varies depending on the kind or the like of the particles and may not be simply defined, it is preferably from 1 part by weight to 50 parts by weight, and more preferably from 5 parts by weight to 20 parts by weight, with respect to 100 parts by weight of the particles. Further, in the present exemplary embodiment, commercially available products are also preferably used as the hydrophobic silica particles that have been subjected to a hydrophobization treatment.

In the particles having oil-treated surfaces, the oil may be present on at least a part of the surfaces of the particles, but it is preferable that equal to or more than 50% by area of the surfaces of the particles be coated with oil; and it is more preferable that equal to or more than 80% by area of the surfaces of the inorganic particles be coated with the oil.

Examples of the method for measuring the coating amount of the oil include a method in which an oil is dyed with a dying agent of an organic compound or an organic silane compound, a toner or the particles are photographed, and the image is analyzed to calculate an average value of 50 or more particles.

Furthermore, the oil in the particles having oil-treated surfaces does not form chemical bonds with the surfaces of the particles and is adhered on the surfaces of the particles. That is, even when physically adsorbed, the oil may be bonded to the surfaces of the particles via chemical bonds, but the oil is preferably physically adsorbed on the surfaces of the particles. Further, in the case where the oil is physically adsorbed, when the toner is used, a part of the oil becomes free or directly adhered to a carrier, a photoreceptor, or the like, from the particles and accordingly, generation of color streaks in the obtained image is further suppressed.

The volume average primary particle diameter of the particles having oil-treated surfaces is preferably from 3 nm to 500 nm, more preferably from 20 nm to 500 nm, still more preferably from 50 nm to 300 nm, and particularly preferably from 70 nm to 140 nm. Within these ranges, the transfer properties of the oil to a carrier, a photoreceptor, or the like are excellent, and thus, generation of color streaks in the obtained image is further suppressed.

The volume average primary particle diameter of the particles having oil-treated surfaces is preferably measured by a Coulter Multisizer II (manufactured by Beckman Coulter, Inc.).

In the toner of the present exemplary embodiment, the content of the particles having oil-treated surface is not particularly limited, but it is preferably from 0.3% by weight to 10% by weight, more preferably from 0.5% by weight to 5% by weight, and still more preferably from 0.8% by weight to 2.0% by weight, with respect to the total weight of the toner.

The method for preparing the particles having oil-treated surfaces is not particularly limited, but a known method is used. Further, it is not necessary to carry out a chemical treatment, and even in the state where the oil is physically adsorbed on the surfaces of the particles, the effect of the present exemplary embodiment of the invention is sufficiently exhibited.

Examples of the method for a physical adsorption treatment include a drying method by, for example, a spray-drying process in which an oil or a liquid containing an oil is sprayed onto particles that float in the air; and a method in which particles are dipped in a liquid containing an oil, and then dried. Further, inorganic particles that have been subjected to a physical adsorption treatment may be heated to allow the oil to be chemically treated on the surfaces of the particles.

In the toner of the present exemplary embodiment, the treatment amount of the oil for the particles (the content of the oil in the toner) is preferably equal to or more than 0.16% by weight, and more preferably equal to or more than 0.26% by weight, and preferably equal to or less than 5% by weight, more preferably equal to or less than 1% by weight, and still more preferably equal to or less than 0.50% by weight, with respect to the total weight of the toner. Within these ranges, the transfer properties of the oil to a carrier, a photoreceptor, or the like are excellent, and thus, generation of color streaks in the obtained image is further suppressed.

Composite Particles Containing Silica and Titania

The toner of the present exemplary embodiment includes composite particles containing silica and titania as an external additive. By incorporating the composite particles containing silica and titania as an external additive, the charging properties of the toner are excellent, and an image having less density variation even under a high temperature and high humidity environment may be obtained even when the particles having oil-treated surfaces are included as an external additive.

The volume average primary particle diameter of the composite particles containing silica and titania is preferably from 3 nm to 500 nm, more preferably from 20 nm to 500 nm, and still more preferably from 60 nm to 500 nm. Within these ranges, an image having less density variation even under a high temperature and high humidity environment may be obtained.

The volume average primary particle diameter of the composite particles containing silica and titania is preferably measured by a Coulter Multisizer II (manufactured by Beckman Coulter, Inc.).

In the toner of the present exemplary embodiment, the content of the composite particles containing silica and titania is not particularly limited, but it is preferably from 0.3% by weight to 10% by weight, more preferably from 0.5% by weight to 5% by weight, and still more preferably from 0.8% by weight to 2.0% by weight, with respect to the total weight of the toner.

Furthermore, in the toner of the present exemplary embodiment, the content ratio of the particles having oil-treated surfaces and the composite particles containing silica and titania is not particularly limited, but it is preferably from 10:1 to 1:10, more preferably from 5:1 to 1:5, and still more preferably from 3:1 to 1:3, in terms of weight ratio.

The method for preparing the composite particles containing silica and titania is not particularly limited, but it is preferably a method including preparing an alkali catalyst solution including an alkali catalyst in a solvent containing an alcohol, supplying metal alkoxide monomers and the alkali catalyst into the alkali catalyst solution, and generating particles.

The method for preparing metal alkoxide monomers may be a method of mixing tetraalkoxytitanium monomers in tetraalkoxysilane monomers, a method of mixing tetraalkoxysilane monomers in tetraalkoxytitanium monomers, a method of adding tetraalkoxysilane dropwise to form particles thereof, and then adding tetraalkoxytitanium dropwise to grow the particles, or a method of adding tetraalkoxytitanium dropwise to form particles thereof, and then adding tetraalkoxysilane dropwise to grow the particles.

Preparation

The method for preparing the composite particles containing silica and titania preferably includes preparing an alkali catalyst solution including an alkali catalyst in a solvent containing an alcohol (preparation).

For the preparation, a solvent containing an alcohol is prepared, and an alkali catalyst is added thereto to prepare an alkali catalyst solution.

The solvent containing an alcohol may be a solvent including an alcohol alone, or if desired, a mixed solvent including an alcohol in combination with other solvents such as water, ketones such as acetone, methyl ethyl ketone, and methyl isobutyl ketone, cellosolves such as methylcellosolve, ethylcellosolve, butylcellosolve, and cellosolve acetate, or ethers of dioxane and tetrahydrofuran. In the case of the mixed solvent, the amount of the alcohol with respect to the other solvents is preferably equal to or more than 80% by weight, and more preferably equal to or more than 90% by weight.

Examples of the alcohol include lower alcohols such as methanol and ethanol.

The alkali catalyst is a catalyst for promoting the reaction (hydrolysis reaction or condensation reaction) of metal alkoxides of tetraalkoxysilane and tetraalkoxytitanium, and examples thereof include basic catalysts such as ammonia, urea, monoamines, and quaternary ammonia salts, with ammonia being particularly preferred.

The concentration (content) of the alkali catalyst is preferably from 0.6 mol/L to 0.85 mol/L. Within these ranges, when tetraalkoxysilane is supplied in the formation of particles, the dispersibility of the generated core particles in the growth process of the core particles becomes stable, generation of coarse aggregates such as secondary aggregates may be suppressed, and formation of gels is thus suppressed. Further, the concentration of the alkali catalyst is a concentration for an alcohol catalyst solution (alkali catalyst+solvent containing an alcohol).

Generation of Particles

The method for preparing the composite particles containing silica and titania preferably includes supplying metal alkoxide monomers and the alkali catalyst into the alkali catalyst solution to generate particles (generation of particles).

The generation of particles is preferably a process in which metal alkoxide and an alkali catalyst are each supplied into an alkali catalyst solution, and the metal alkoxide is subjected to a reaction (hydrolysis reaction or condensation reaction) in the alkali catalyst solution to generate composite silica particles. In such generation of particles, after the core particles of the metal alkoxide are generated at an initial time of supplying the metal alkoxide, core particles then grow to generate composite silica particles. The supply amount of the metal alkoxide is preferably, for example, from 0.001 mol/(mol·min) to 0.01 mol/(mol·min) with respect to the number of moles of the alcohol in the alkali catalyst solution.

By setting the supply amount of the metal alkoxide to these ranges, generation of coarse aggregates is reduced and silica particles having atypical shapes are easily generated. Further, the supply amount of the metal alkoxide represents the number of moles of the metal alkoxide supplied per minute to one mole of the alcohol in the alkali catalyst solution.

On the other hand, examples of the alkali catalyst supplied into the alkali catalyst solution include those exemplified above. This alkali catalyst supplied may be the same as or different from the alkali catalyst which is included in the alkali catalyst solution in advance, but is preferably the same. The supply amount of the alkali catalyst is preferably from 0.1 mole to 0.4 mole per mole of the total supply amount of the metal alkoxide to be supplied per minute. Herein, in the generation of particles, the metal alkoxide and the alkali catalyst are each supplied to the alkali catalyst solution, but this supply method may be a continuous supply method or an intermittent supply method.

In the generation of particles, the temperature inside the alkali catalyst solution (the temperature at a time of the supply) is preferably, for example, from 5° C. to 50° C.

After the above steps, composite particles containing silica and titania may be obtained. The composite particles obtained in this state is obtained in the state of a dispersion, but may be used as a composite particle dispersion as is, or may be used in the state of powder of the composite particles containing silica and titania taken out after removing the solvent. When used as a composite particle dispersion, the solid content concentration of the composite particle may be adjusted by dilution with water or alcohol or by concentration, if necessary. In addition, the composite silica particle dispersion may be used after the replacement of the solvent with an organic water-soluble solvent such as other alcohols, esters, and ketones.

On the other hand, when used as powder of the composite particles containing silica and titania, it is necessary to remove the solvent from the composite particle dispersion, but examples of the method for removing the solvent include known methods such as 1) a method in which the solvent is removed by filtration, centrifugation, distillation, or the like, followed by drying with a dry vacuum dryer, a shelf dryer, or the like, and 2) a method in which a slurry is directly dried with a fluidized-bed dryer, a spray dryer, or the like. The drying temperature is not particularly limited, but it is preferably equal to or lower than 200° C.

The dried composite particles containing silica and titania are preferably pulverized and sieved, if necessary, to remove the coarse particles and agglomerates. The pulverizing method is not particularly limited, but examples thereof include a method using a dry type pulverizing device such as a jet mill, a vibration mill, a ball mill, and a pin mill. Examples of the sieving method include methods that are carried out in any known manner, for example, using as a vibration sieve or a wind classifier.

The composite particles containing silica and titania may be used after the surfaces of the composite particles have been treated with a hydrophobizing agent. Examples of the hydrophobizing agent include known organic silicon compounds having alkyl groups (for example, a methyl group, an ethyl group, a propyl group, and a butyl group), and specifically, silazane compounds (for example, silane compounds such as methyltrimethoxysilane, dimethyldimethoxysilane, trimethylchlorosilane, and trimethylmethoxysilane, hexamethyldisilazane, and tetramethyldisilazane). One kind or plural kinds of the hydrophobizing agent may be used. Among these hydrophobizing agents, organic silicon compounds having trimethyl groups, such as trimethylmethoxysilane and hexamethyldisilazane, are suitable. The amount of the hydrophobizing agent used is not particularly limited, but it is preferably, for example, from 1% by weight to 100% by weight, and more preferably from 5% by weight to 80% by weight, with respect to the composite particles, in order to obtain the effect of the hydrophobization.

Examples of the method for obtaining a hydrophobized composite particle dispersion that has been treated with a hydrophobizing agent include a method in which a required amount of a hydrophobizing agent is added to a composite particle dispersion, followed by performing a reaction at a temperature in the range of 30° C. to 80° C. under stirring, thereby obtaining a hydrophobized silica particle dispersion.

On the other hand, the method for obtaining powder of the hydrophobized composite particles preferably includes a method in which a hydrophobized composite particle dispersion is obtained by the above-described method, and then dried by the above-described method to obtain powder of the hydrophobized composite particles; a method in which a composite particle dispersion is dried to obtain powder of hydrophilic composite particles, and a hydrophobizing agent is added to the mixture to conduct a hydrophobization treatment, thereby obtaining powder of the hydrophobized composite particles; and a method in which a hydrophobized composite particle dispersion is obtained and then dried to obtain powder of the hydrophobized composite particles, and a hydrophobizing agent is added to the mixture to conduct a hydrophobization treatment, thereby obtaining powder of the hydrophobized composite particles. Herein, examples of the method for obtaining the powder of the hydrophobized composite particles include a method in which powder of hydrophilic composite particles is stirred in a treatment tank such as a Henschel mixer and a fluidized bed, a hydrophobizing agent is added thereto, and the inside of the treatment tank is heated to make the hydrophobizing agent become gas to be reacted with silanol groups on the surfaces of the powder of the composite particles. The treatment temperature is not particularly limited, but it is preferably, for example, from 80° C. to 300° C., and more preferably from 120° C. to 200° C.

Other External Additive

The toner of the present exemplary embodiment may include external additives other than the particles having oil-treated surfaces and the composite particles containing silica and titania (which is also referred to as "other external additives").

The content of such other external additives in the toner of the present exemplary embodiment may be less than that of each of the particles having oil-treated surfaces and the composite particles containing silica and titania.

Examples of such other external additives include the inorganic particles as described above and the resin particles as described above. Further, such other external additives may be ones that have been treated with the hydrophobization agent described above.

The average primary particle diameter of the other external additives is preferably from 3 nm to 500 nm, more preferably from 5 nm to 100 nm, still more preferably from 5 nm to 50 nm, and particularly preferably from 5 nm to 40 nm.

The toner particles are specifically configured to include, for example, a binder resin, a colorant, and a release agent, and if desired, other additives.

The binder resin is not particularly limited, but examples thereof include homopolymers including monomers, for example, styrenes such as styrene, parachlorostyrene, and α-methylstyrene; esters having vinyl groups, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate; vinyl nitriles, such as acrylonitrile and methacrylonitrile; vinyl ethers such as vinyl methyl ether, and vinyl isobutyl ether; vinyl ketones such as vinyl methyl ketone, vinyl ethyl ketone, and vinyl isopropenyl ketone; and polyolefins such as ethylene, propylene, and butadiene; or copolymers obtained by the combination of two or more kinds of these monomers; a mixture thereof, and further non-vinyl condensed resins such as an epoxy resin, a polyester resin, a polyurethane resin, a polyamide resin, a cellulose resin, and a polyether resin, a mixture thereof with the vinyl resin, and a graft polymer obtained by the polymerization of vinyl monomers in the co-existence of these monomers.

The styrene resin, the (meth)acryl resin, and the styrene-(meth)acryl copolymer resin may be obtained from, for example, styrene monomers and (meth)acrylic ester monomers singly or in appropriate combination thereof by a known method. Further, the "(meth)acryl" is an expression that encompasses at least one of "acryl" and "methacryl".

The polyester resin may be obtained by selecting appropriate ones from dicarboxylic acid components and diol components, and combining them, followed by synthesizing by a method known in the related art, such as a transesterification method and a polycondensation method.

In the case where a styrene resin, a (meth)acryl resin, or a styrene-(meth)acryl copolymer resin is used as a binder resin, one having a weight average molecular weight Mw in the range of 20,000 to 100,000 and a number average molecular weight Mn in the range of 2,000 to 30,000 is preferably used. On the other hand, in the case where a polyester resin is used as a binder resin, one having a weight average molecular weight Mw in the range of 5,000 to 40,000 and a number average molecular weight Mn in the range of 2,000 to 10,000 is preferably used.

The glass transition temperature of the binder resin is preferably in the range of 40° C. to 80° C. When the glass transition temperature is in the range, the lowest fixing temperature is easily maintained.

The colorant is not particularly limited as long as it is a known colorant, but examples thereof include carbon black such as furnace black, channel black, acetylene black, and thermal black; inorganic pigments such as red oxide, Prussian blue, and titanium oxide; azo pigments such as fast yellow, disazo yellow, pyrazolone red, chelate red, brilliant carmine, and parabrown; phthalocyanine pigments such as copper phthalocyanine and non-metallic phthalocyanine; and condensed polycyclic pigments such as flavanthrone yellow, dibromoanthrone orange, perylene red, quinacridone red, and dioxazine violet.

As the colorant, if necessary, a colorant that has been subjected to a surface treatment may be used or a colorant may be used in combination with a dispersion. Further, a combination of plural kinds of the colorants may be used concurrently.

The content of the colorant is preferably in the range of 1% by weight to 30% by weight with respect to the total weight of the binder resin.

Examples of the release agent include, but are not limited to, hydrocarbon-based waxes; natural waxes such as a carnauba wax, a rice wax, and a candelilla wax; synthetic or mineral/petroleum-based waxes such as a montan wax; and ester-based waxes such as fatty acid waxes and montanic ester.

The melting point of the release agent is preferably equal to or higher than 50° C., and more preferably equal to or higher than 60° C. from the viewpoint of preservability. Further, it is preferably equal to or lower than 110° C., and more preferably equal to lower than 100° C., from the viewpoint of anti-offset properties.

The content of the release agent is preferably from 1% by weight to 15% by weight, preferably from 2% by weight to 12% by weight, and still more preferably from 3% by weight to 10% by weight.

Examples of other additives include magnetic materials, charge control agents, and inorganic powder.

The shape factor SF1 of the toner particles is preferably from 125 to 140, more preferably from 125 to 135, and still more preferably from 130 to 135, and the shape factor SF2 is preferably from 105 to 130, more preferably from 110 to 125, and still more preferably from 115 to 120.

The shape factor SF1 of the toner particles is determined by the following formula.

$$SF1=(ML^2/A)\times(n/4)\times 100 \qquad \text{Formula: Shape factor}$$

wherein ML represents the absolute maximum length of the toner particles and A represents the projected area of the toner particles.

Microphotographs or scanning electron microscopic (SEM) images are analyzed with an image analyzer, and the shape factor SF1 is expressed as a numerical value. The shape factor SF1 is computed, for example, as follows. An optical micrographic image of the toner particles scattered on the surface of a slide glass is put into an image analyzer, LUZEX, through a video camera, and the maximum lengths and the projected areas of 100 toner particles are found, calculated according to the above formula, and the shape factor SF1 is obtained by determining the average value.

The shape factor SF2 of the toner particles is determined in the following manner.

The toner particles are observed using a scanning electron microscope (for example, S-4100 manufactured by Hitachi Co., Ltd.) to photograph images, and the images are input to an image analyzer (for example, LUZEX III, manufactured by Nireco Corporation), and for each of 100 toner particles, SF2 is calculated on the basis of the following formula, and an average value thereof is determined and taken as a shape factor SF2. In addition, the electron microscope is adjusted to a magnification to reflect about 3 to 20 external additives in one field of view, and the SF2 is calculated based on the following formula in accordance with the observation of plural fields of view.

$$SF2=(PM^2/(4\cdot A\cdot\pi))\times 100 \quad \text{Formula: Shape factor}$$

wherein PM represents the perimeter of the toner particle, A represents the projected area of the toner particle, and π represents a pi.

The volume average particle diameter of the toner particles is preferably from 2 μm to 10 μm, and more preferably from 4 μm to 8 μm.

The volume average particle diameter of the toner particles is measured using a Coulter Multisizer II (manufactured by Beckman Coulter, Inc.) with an aperture diameter of 50 μm. Herein, the measurement is carried out after dispersing the toner particles in an aqueous electrolytic solution (aqueous ISOTON solution), and dispersing by ultrasonic waves for 30 seconds or longer.

For this measurement method, 0.5 mg to 50 mg of a measurement sample is put into 2 mL of an aqueous surfactant solution, which is preferably a 5% aqueous solution of sodium alkylbenzenesulfonate, as a dispersant, and is then added to 100 mL to 150 mL of the electrolytic solution. The electrolytic solution having the measurement sample suspended therein is subjected to a dispersion treatment for about 1 minute with an ultrasonic dispersing device, and the particle size distribution of the particles is measured. The number of particles to be measured is 50,000.

The particle size distribution thus measured is divided into particle size ranges (channels), and an accumulated distribution is drawn for volume from the small size side. The particle diameter at an accumulation of 50% is defined as a volume average particle diameter.

Electrostatic Charge Image Developer

The electrostatic charge image developing toner of the present exemplary embodiment is suitably used as an electrostatic charge image developer.

The electrostatic charge image developer of the present exemplary embodiment is not particularly limited, except for containing the electrostatic charge image developing toner of the present exemplary embodiment, and it can take a suitable component composition depending upon the purpose. When the electrostatic charge image developing toner of the present exemplary embodiment is used singly, an electrostatic charge image developer of a single-component system is prepared, and when the electrostatic charge image developing toner of the present exemplary embodiment is used in combination with a carrier, an electrostatic charge image developer of a two-component system is prepared.

As for the single-component developer, a method in which frictional electrification with a developing sleeve or charge member is performed to form a charged toner, followed by developing depending upon an electrostatic latent image is also applied.

In the present exemplary embodiment, the development system is not specified, but a two-component development system is preferred. Further, so far as the above-described conditions are satisfied, the carrier is not particularly specified. However, examples of a core material of the carrier include magnetic metals such as iron, steel, nickel, and cobalt; alloys thereof with manganese, chromium, a rare earth metal or the like; and magnetic oxides such as ferrite and magnetite. From the viewpoints of core material surface properties and core material resistance, an alloy thereof with, for example, ferrite, particularly manganese, lithium, strontium, or magnesium is preferred.

The carrier that is used in the present exemplary embodiment is preferably one obtained by coating a resin on the core material surface. The resin is not particularly limited and is properly chosen depending upon the purpose. Examples thereof include known resins, such as polyolefin resin such as polyethylene and polypropylene; polyvinyl resin and polyvinylidene resin such as polystyrene, acrylic resin, polyacrylonitrile, polyvinyl acetate, polyvinyl alcohol, polyvinyl butyral, polyvinyl chloride, polyvinylcarbazole, polyvinyl ether, and polyvinyl ketone; a vinyl chloride-vinyl acetate copolymer; a styrene-acrylic acid copolymer; a straight-chain silicone resin composed of an organosiloxane bond or modified products thereof; fluorine resin such as polytetrafluoroethylene, polyvinyl fluoride, polyvinylidene fluoride, and polychlorotrifluoroethylene; silicone resin; polyester; polyurethane; polycarbonate; phenol resin; amino resin such as a urea-formaldehyde resin, a melamine resin, a benzoguanamine resin, a urea resin, and a polyamide resin; and epoxy resin. These resins may be used singly or in combinations of two or more kinds thereof. In the present exemplary embodiment, among these resins, it is preferable to use at least a fluorine resin and/or a silicone resin. The use of at least a fluorine resin and/or a silicone resin as the resin is beneficial in view of the fact that the effect of preventing carrier contamination (impaction) due to the toner or external additive is high.

As for the coating film made of the resin, it is preferable that resin particles and/or conductive particles be dispersed in the resin. Examples of the resin particles include a thermoplastic resin particle and a thermosetting resin particle. Among these, a thermosetting resin is preferable from the viewpoint that it is relatively easy to increase the hardness, and a resin particle composed of a nitrogen-containing resin containing N atoms is preferable from the viewpoint of imparting negative chargeability to the toner. These resin particles may be used singly or in combinations of two or more kinds thereof. An average particle diameter of the resin particles is preferably from 0.1 μm to 2 μm, and more preferably from 0.2 μm to 1 μm. When the average particle diameter of the resin particles is equal to or more than 0.1 μm, the dispersibility of the resin particles in the coating film is excellent, whereas when the average particle diameter of the resin particles is equal to or less than 2 μm, dropping of the resin particles from the coating film hardly occurs.

Examples of the conductive particle include metal particles of gold, silver, copper and the like; carbon black particles; and particles obtained by coating the surface of, for example, powder of titanium oxide, zinc oxide, barium sulfate, aluminum borate, potassium titanate, or the like with tin oxide, carbon black, a metal, or the like. These materials may be used singly or in combinations of two or more kinds thereof. Among these, carbon black particles are preferable in view of the fact that manufacturing stability, costs, conductivity, and the like are favorable. The kind of carbon black is not particularly limited, but carbon black having a DBP oil absorption amount of from 50 ml/100 g to 250 ml/100 g is preferred because of its excellent manufacturing stability. The coating amount of each of the resin, the resin particle and the conductive particle on the core material surface is preferably from 0.5% by weight to 5.0% by weight, and more preferably from 0.7% by weight to 3.0% by weight.

A method for forming the coating film is not particularly limited, but examples thereof include a method using a coating film forming solution in which the resin particles such as crosslinking resin particles and/or the conductive particles, and the resin such as a styrene-acrylic resin, a fluorine resin and a silicone resin as a matrix resin are contained in a solvent.

Specific examples thereof include a dipping method of dipping the carrier core material in the coating film forming solution; a spray method of spraying the coating film forming solution onto the surface of the carrier core material; and a kneader coater method of mixing the coating film forming solution and the carrier core material in a state where it is floated by flowing air and removing the solvent. Among these, the kneader coater method is preferred in the present exemplary embodiment.

The solvent used in the coating film forming solution is not particularly limited as long as it is capable of dissolving only the resin that is a matrix resin. The solvent is chosen from known solvents, and examples thereof include aromatic hydrocarbons such as toluene and xylene, ketones such as acetone and methyl ethyl ketone, and ethers such as tetrahydrofuran and dioxane. In the case where the resin particles are dispersed in the coating film, since the resin particles and the particles as a matrix resin are uniformly dispersed in the thickness direction thereof and in the circumferential direction to the carrier surface, even when the carrier is used for a long period of time, and the coating film is abraded, the surface formation which is similar to that of an unused state can be permanently maintained, and a favorable ability for applying electrification to the toner can be maintained over a long period of time. Also, in the case where the conductive particles are dispersed in the coating film, since the conductive particles and the resin as a matrix resin are uniformly dispersed in the thickness direction thereof and in a circumferential direction to the carrier surface, even when the carrier is used for a long period of time, and the coating film is abraded, the surface formation which is similar to that of an unused state can be permanently maintained, and deterioration of the carrier can be prevented over a long period of time. In the case where the resin particles and the conductive particles are dispersed in the coating film, the above-described effects are exhibited at the same time.

The electric resistivity of the entire magnetic carrier thus formed in a magnetic brush state in an electric field of $10^4$ V/cm is preferably from $10^8$ Ωm to $10^{13}$ Ωcm. When the electric resistivity of the magnetic carrier is equal to or more than $10^8$ Ωcm, adhesion of the carrier to an image area on the image holding member is suppressed, and a brush mark is hardly generated. On the other hand, where the electric resistivity of the magnetic carrier is equal to or less than $10^{13}$ Ωcm, the generation of an edge effect is suppressed, and a favorable image quality is obtainable.

Furthermore, the electric resistivity (intrinsic volume resistivity) is measured as follows.

A sample is placed on a lower pole plate of a measuring jig that is a pair of 20-$cm^2$ circular pole plates (made of steel) connected to an electrometer (trade name: KEITHLEY 610C, manufactured by Keithley Instruments Inc.) and a high-voltage power supply (trade name: FLUKE 415B, manufactured by Fluke Corporation), so as to form a flat layer having a thickness of from about 1 mm to 3 mm. Subsequently, after the upper pole plate is placed on the sample, in order to make a sample-to-sample space free, a weight of 4 kg is placed on the upper pole plate. A thickness of the sample layer is measured in this state. Subsequently, by applying a voltage to both pole plates, a current value is measured, and an intrinsic volume resistivity is calculated according to the following formula:

Intrinsic volume resistivity=Applied voltage×20÷(Current value-Initial current value)÷Sample Thickness wherein the initial current value is a current value when the applied voltage is 0, and the current value is a measured current value.

As for a mixing ratio of the toner of the present exemplary embodiment to the carrier in the electrostatic charge image developer of a two-component system, the amount of the toner is preferably from 2 parts by weight to 10 parts by weight based on 100 parts by weight of the carrier. Further, a method for preparing the developer is not particularly limited, but examples thereof include a method of mixing by a V blender or the like.

Image Forming Method

Moreover, the electrostatic charge image developer (toner for developing an electrostatic charge image) is used for an image forming method in an electrostatic charge image development system (electrophotographic system).

The image forming method of the present exemplary embodiment includes charging a surface of an image holding member; forming an electrostatic latent image on the surface of the image holding member; developing the electrostatic latent image formed on the surface of the image holding member by a developer containing a toner to form a toner image; and transferring the toner image onto the surface of a recording member; and may further include fixing the toner image transferred onto the surface of the recording member, wherein the electrostatic charge image developing toner of the present exemplary embodiment or the electrostatic charge image developer of the present exemplary embodiment is used as the developer. The method may further include cleaning, as necessary.

The respective steps above are general steps themselves, and are disclosed in, for example, JP-A-56-40868 and JP-A-49-91231. Further, the image forming method of the present exemplary embodiment may be implemented using a known image forming apparatus, such as a copier and a facsimile machine.

The formation of an electrostatic latent image is a process for forming an electrostatic latent image on an image holding member (photoreceptor).

The development is a process for developing the electrostatic latent image by a developer layer on a developer holding member to form a toner image. The developer layer is not particularly limited as long as it contains the electrostatic charge image developing toner of the present exemplary embodiment.

The transfer is a process for transferring the toner image onto a recording member. Further, examples of the recording member in the transfer include recording media such as an intermediate transfer member and paper.

In the fixing above, for example, a system in which a toner image transferred onto a transfer paper by a heating roller fixing machine with a temperature of a heating roller set at a constant temperature is fixed to form a transferred image, may be mentioned.

The cleaning is to remove the electrostatic charge image developer remaining on the image holding member.

Furthermore, the image forming method of the present exemplary embodiment preferably includes the cleaning, and more preferably includes removing the electrostatic charge image developer remaining on the image holding member by a cleaning blade.

As the recording medium, known ones may be used, and examples thereof include paper and OHP sheets used in a copier or printer in an electrophotographic system. For example, coat paper obtained by coating the surface of plain paper with a resin or the like, and printing art paper may be suitably used.

The image forming method of the present exemplary embodiment may also include recycling. The recycling is to transfer the electrostatic charge image developing toner that has been recovered in the cleaning to a developer layer. The image forming method including the recycling is carried out by using an image forming apparatus such as a copier and a facsimile machine, having a toner recycling system type. Further, it may also be applied to a recycling system in which a toner is recovered at the same time with developing.

Image Forming Apparatus

The image forming apparatus of the present exemplary embodiment includes an image holding member, a charging unit that charges a surface of the image holding member, an electrostatic latent image forming unit that forms an electrostatic latent image on the surface of the image holding member, a development unit that develops the electrostatic latent image by a developer containing a toner to form a toner image, and a transfer unit that transfers the toner image from the image holding member onto the surface of a recording member, and may further include a fixing unit that fixes the toner image transferred onto the surface of a recording member, wherein the electrostatic charge image developing toner of the present exemplary embodiment or the electrostatic charge image developer of the present exemplary embodiment is used as the developer.

Furthermore, the image forming apparatus of the present exemplary embodiment is not particularly limited as long as it includes at least the image holding member, the charging unit, the exposure unit, the developing unit, and the transfer unit, as described above. Further, for example, a fixing unit, a cleaning unit, or an erasing unit may be further included therein, if desired.

In the transfer unit, the transfer may be carried out two or more times using an intermediate transfer member. Further, examples of the recording member in the transfer unit include recording media such as an intermediate transfer member and paper.

In the image holding member and the respective units, the constitution described in each step in the image forming method may be preferably used. As each of the units, any of units known in the image forming apparatus are utilized. Further, the image forming apparatus used in the present exemplary embodiment may include units, apparatuses, and the like other than the above-described constitution. In addition, in the image forming apparatus of the present exemplary embodiment, two or more of the above-described units may be used at the same time.

Furthermore, the image forming apparatus of the present exemplary embodiment preferably includes a cleaning unit that removes the electrostatic charge image developer remaining in the image holding member.

Examples of the cleaning unit include a cleaning blade and a cleaning brush, but the cleaning blade is preferred.

Preferred examples of the material for the cleaning blade include urethane rubber, neoprene rubber, and silicone rubber.

Toner Cartridge, Developer Cartridge, and Process Cartridge

The toner cartridge of the present exemplary embodiment is a toner cartridge including a toner containing chamber that accommodates at least the electrostatic charge image developing toner of the present exemplary embodiment therein.

The developer cartridge of the present exemplary embodiment is a developer cartridge including a developer containing chamber that accommodates at least the electrostatic charge image developer of the present exemplary embodiment therein.

Furthermore, the process cartridge of the present exemplary embodiment is a process cartridge which includes at least one selected from the group consisting of a developing unit that develops the electrostatic latent image formed on the surface of the image holding member by the electrostatic charge image developing toner or the electrostatic charge image developer to form a toner image, an image holding member, a charging unit that charges the surface of the image holding member, and a cleaning unit that removes the toner remaining on the surface of the image holding member, and which accommodates at least the electrostatic charge image developing toner of the present exemplary embodiment or the electrostatic charge image developer of the present exemplary embodiment therein.

The toner cartridge of the present exemplary embodiment is preferably detachable from an image forming apparatus. That is, the toner cartridge of the present exemplary embodiment that accommodates the toner of the present exemplary embodiment therein is preferably used in the image forming apparatus which is configured to have the toner cartridge detachable therefrom.

The developer cartridge of the present exemplary embodiment is not particularly limited as long as it contains an electrostatic charge image developer including the electrostatic charge image developing toner of the present exemplary embodiment. For example, the developer cartridge is detachable from an image forming apparatus including a developing unit and accommodates an electrostatic charge image developer including the electrostatic charge image developing toner of the present exemplary embodiment as a developer to be supplied to the developing unit.

Furthermore, the developer cartridge may be a cartridge that accommodates a toner and a carrier therein, or may have a constitution that a cartridge accommodating a toner alone therein and a cartridge accommodating a carrier alone therein are separate cartridges.

The process cartridge of the present exemplary embodiment is preferably detachable from an image forming apparatus.

In addition, the process cartridge of the present exemplary embodiment may contain other members such as an erasing unit, if desired.

For the toner cartridge and the process cartridge, known constitutions which are disclosed, for example, in JP-A-2008-209489 and JP-A-2008-233736, may be employed.

EXAMPLES

Hereinbelow, the present exemplary embodiment will be described in detail with reference to Examples, but is not construed to be limited thereto. Further, in the following description, "part(s)" mean(s) "part(s) by weight" unless otherwise specified.

Method for Measuring Content Ratio of Titania with Respect to Silica on Outermost Surface of Toner, as Measured by X-Ray Photoelectron Spectroscopy The content ratio of titania with respect to silica in the outermost surface of the toner is measured by carrying out XPS measurement using an X-ray photoelectron spectroscopy device (JPS9000MX, manufactured by JEOL Ltd.) under the measurement conditions of an acceleration voltage of 10 kV and a current value of 30 mA.

Method for Measuring Content of Titania with Respect to Silica in Entire Toner

By using a toner with the addition amount in the range of 1% by weight to 10% by weight of silica and titania with an increment of 1% by weight, a calibration curve of the addition amount and the Net intensity of the elemental Si and the elemental Ti is prepared by the measurement with fluorescent X-rays. The content of titania with respect to silica in the entire toner is calculated using the calibration curve thus obtained from the Net intensity of the elemental Si and the elemental Ti with fluorescent X-rays.

Method for Measuring Volume Average Particle Diameter of Toner Particles

The volume average particle diameter of the toner particles is measured using a Coulter Multisizer II (manufactured by Beckman Coulter, Inc.). As the electrolytic solution, ISOTON-II (manufactured by Beckman Coulter, Inc.) is used.

For this measurement method, 0.5 mg to 50 mg of a measurement sample is put into 2 mL of an aqueous surfactant solution, which is preferably a 5% aqueous solution of sodium alkylbenzenesulfonate, as a dispersant, and is then added to 100 mL to 150 mL of the electrolytic solution. The electrolytic solution having the measurement sample suspended therein is subjected to a dispersion treatment for about 1 minute with an ultrasonic dispersing device, and the particle size distribution of the particles having a particle size in the range of 2.0 μm to 60 μm is measured using an aperture having an aperture diameter of 100 μm by a Coulter Multisizer II. The number of particles to be measured is 50,000.

The particle size distribution thus measured is divided into particle size ranges (channels), and an accumulated distribution is drawn for weight or volume from the small size side. The particle diameter at an accumulation of 50% is defined as a weight average particle diameter or a volume average particle diameter.

Measurement of Glass Transition Point of Resin Particles or Resin in Resin Dispersion The glass transition temperature Tg of the resin is measured using a differential scanning calorimeter (DSC50, manufactured by Shimadzu Corporation).

Preparation of Composite Particles A

Into a glass reaction vessel equipped with a stirrer, dripping nozzles, and a thermometer, 400 parts of methanol and 66 parts of 10% aqueous ammonia ($NH_4OH$) are added and mixed to obtain an alkali catalyst solution. At this time, in the alkali catalyst solution, the amount of the catalyst:amount of $NH_3$ ($NH_3$/($NH_3$+methanol+water)) is 0.68 mol/L. Further, after adjusting the temperature of the alkali catalyst solution to 25° C., the mixture is stirred while the flow rates of 200 parts of tetrabutoxytitanium monomers and 158 parts of 3.8% aqueous ammonia ($NH_4OH$) are adjusted so as to set the amount of $NH_3$ with respect to 1 mole of the total supply amount of the tetrabutoxytitanium monomers supplied per minute to 0.27 mol, and started to be added at the same time and added dropwise for 60 minutes to obtain a suspension of titania particles. Thereafter, 2 parts of tetramethoxysilane monomers and 1.58 parts of 3.8% aqueous ammonia ($NH_4OH$) are added thereto with the same flow rates while stirring so as to give the ratio of tetramethoxysilane with respect to tetrabutoxytitanium of 1.0%, thereby obtaining a slurry of silica-coated titania particles.

After evaporating 300 parts of the slurry by heating, 300 parts of pure water is added thereto, and then the mixture is dried by a freeze dryer to obtain silica-coated titania particles.

In addition, 7 parts of hexamethyldisilazane is added to 35 parts of the silica-coated titania particles, followed by performing a reaction at 150° C. for 2 hours, to obtain hydrophobic silica-coated titania particles.

The volume average primary particle diameter of the composite particle A is 65 nm.

Preparation of Composite Particles B to F

In the same manner as above except that the following conditions are changed in the preparation of the composite particles A, each of composite particles B to F are prepared.

Under the condition that the proportion of tetramethoxysilane with respect to tetrabutoxytitanium for the composite particles A is set to 10%, composite particles B are prepared. The volume average primary particle diameter of the composite particle B is 75 nm.

Under the condition that the proportion of tetramethoxysilane with respect to tetrabutoxytitanium for the composite particles A is set to 0.1%, composite particles C are prepared. The volume average primary particle diameter of the composite particle C is 50 nm.

Under the condition that the proportion of tetramethoxysilane with respect to tetrabutoxytitanium for the composite particles A is set to 0.5%, composite particles D are prepared. The volume average primary particle diameter of the composite particle D is 55 nm.

Under the condition that the proportion of tetramethoxysilane with respect to tetrabutoxytitanium for the composite particles A is set to 0.8%, composite particles E are prepared. The volume average primary particle diameter of the composite particle E is 60 nm.

Under the condition that the proportion of tetramethoxysilane with respect to tetrabutoxytitanium for the composite particles A is set to 13%, composite particles F are prepared.

The volume average primary particle diameter of the composite particle F is 80 nm.

Preparation of Oil-Treated Silica Particles

Into a glass reaction vessel equipped with a stirrer, dripping nozzles, and a thermometer, 400 parts of methanol and 66 parts of 10% aqueous ammonia ($NH_4OH$) are added and mixed to obtain an alkali catalyst solution. At this time, in the alkali catalyst solution, the amount of the catalyst:amount of $NH_3$ ($NH_3$/($NH_3$+methanol+water)) is 0.68 mol/L. Further, after adjusting the temperature of the alkali catalyst solution to 25° C., the mixture is stirred while the flow rates of 200 parts of tetramethoxysilane monomers and 158 parts of 3.8% aqueous ammonia ($NH_4OH$) are adjusted so as to set the amount of $NH_3$ with respect to 1 mole of the total supply amount of tetramethoxysilane supplied per minute to 0.27 mol, and started to be added at the same time and added dropwise for 60 minutes to obtain a suspension of silica particles.

After evaporating 300 parts of the silica slurry by heating, 300 parts of pure water is added thereto, and then the mixture is dried by a freeze dryer to obtain silica particles.

In addition, 7 parts of dimethylsilicone oil is added to 35 parts of the silica particles, followed by performing a reaction at 150° C. for 2 hours, to obtain oil-treated silica particles.

The volume average primary particle diameter of the oil-treated silica particles is 80 nm.

Preparation of Hexamethyldisilazane-Treated Silica Particles

In the same manner as above except that the dimethylsilicone oil is changed to hexamethyldisilazane in the preparation of the oil-treated silica particles, hexamethyldisilazane-treated silica particles are obtained.

The volume average primary particle diameter of the hexamethyldisilazane-treated silica particles is 80 nm.

Preparation of Toner

Preparation of Toner Particles

Preparation of Polyester Resin Dispersion

Ethylene glycol (manufactured by Wako Pure Chemical Industries, Ltd.): 37 parts

Neopentyl glycol (manufactured by Wako Pure Chemical Industries, Ltd.): 65 parts 1,9-Nonanediol (manufactured by Wako Pure Chemical Industries, Ltd.): 32 parts Terephthalic acid (manufactured by Wako Pure Chemical Industries, Ltd.): 96 parts The above monomers are put into a flask and the temperature is raised to 200° C. for 1 hour. After confirming that the reaction system is uniformly stirred, 1.2 parts of dibutyltin oxide is added thereinto. Further, the temperature is further raised to 240° C. for 6 hours with evaporation of the obtained water, and then a dehydration-condensation reaction is allowed to continue at 240° C. for additional 4 hours. A polyester resin having an acid value of 9.4 mg KOH/g, a weight average molecular weight of 13,000, and a glass transition temperature of 62° C. is thus obtained.

Then, the obtained polyester resin in a molten state is transferred to a CAVITRON CD 1010 (manufactured by Eurotec Ltd.) at a rate of 100 parts per minute. Diluted aqueous ammonia having a concentration of 0.37% is prepared by diluting aqueous ammonia as a reagent with deionized water, and put into an aqueous medium tank that is separately prepared. The diluted aqueous ammonia is transferred to the CAVITRON at a rate of 0.1 L per minute while heating it to 120° C. by a heat exchanger, together with the molten polyester resin. The CAVITRON is operated by rotating the rotor under the conditions of a rotation speed of 60 Hz and a pressure of 5 kg/cm$^2$. An amorphous polyester resin dispersion, in which resin particles having a volume average particle diameter of 160 nm, a solid content of 30%, a glass transition temperature of 62° C., and a weight average molecular weight Mw of 13,000 are dispersed, is thus obtained.

Preparation of Colorant Dispersion

Cyan pigment (C.I. Pigment Blue 15:3, manufactured by Dainichiseika Color & Chemicals Mfg. Co., Ltd.): 10 parts Anionic surfactant (NEOGEN SC, manufactured by Daiichi Kogyo Seiyaku Co., Ltd.): 2 parts Deionized water: 80 parts The above components are mixed and dispersed with a high pressure impact type disperser Altimizer (HJP30006, manufactured by Sugino Machine Limited) for 1 hour to obtain a colorant dispersion having a volume average particle diameter of 180 nm and a solid content of 20%.

Preparation of Release Agent Dispersion

Paraffin wax [HNP 9, manufactured by Nippon Seiro Co., Ltd.]: 50 parts

Anionic surfactant [NEOGEN SC, manufactured by Daiichi Kogyo Seiyaku Co., Ltd.]: 2 parts Deionized water: 200 parts The above components are heated to 120° C., and sufficiently mixed and dispersed with an ULTRA TURRAX T50 manufactured by IKA. Then, the mixture is subjected to a dispersion treatment with a pressure ejection type homogenizer to obtain a release agent dispersion having a volume average particle diameter of 200 nm and a solid content of 20%.

Preparation of Toner Particles 1

Polyester resin dispersion: 200 parts

Colorant dispersion: 25 parts

Polyaluminum chloride: 0.4 part

Deionized water: 100 parts

The above components are put into a stainless steel flask, and sufficiently mixed and dispersed using an ULTRA TURRAX manufactured by IKA. Then, the flask is heated to 48° C. while stirring the flask in a heating oil bath. The flask is held at 48° C. for 30 minutes, and 70 parts of the polyester resin dispersion as described above is then moderately added thereto.

Thereafter, the pH in the system is adjusted to 8.0 with an aqueous sodium hydroxide solution of a concentration of 0.5 mol/L, and the stainless steel flask is sealed. The seal of the stirring axis is sealed with a magnetic force seal. The flask is heated to 90° C. while continuing stirring and held for 3 hours. After completion of the reaction, the flask is cooled at a cooling rate of 2° C./rain, and the mixture is filtered and sufficiently washed with deionized water, followed by solid-liquid separation with a Nutsche suction filter. The solid is re-dispersed in 3,000 parts of deionized water at 30° C., followed by stirring and washing at 300 rpm for 15 minutes. This washing operation is repeated more six times, and when the filtrate has a pH of 7.54, and an electric conductivity of 6.5 μS/cm, solid-liquid separation is conducted using No. 5A filter paper by a Nutsche suction filter. Then, vacuum drying is continued for 12 hours to obtain toner particles 1.

The volume average particle diameter $D_{50v}$ of the toner particles (1) is measured with a Coulter counter and found to be 5.8 μm, and the SF1 is 130.

Preparation of External Addition Toner

External Addition Toner (1)

4% by weight of oil-treated silica particles and 0.5% by weight of the composite particle A are added to the toner particles (1), and mixed with a sample mill at 15,000 rpm for 30 seconds to obtain an external addition toner (1).

External Addition Toner (2)

4% by weight of oil-treated silica particles and 0.5% by weight of the composite particle B are added to the toner particles (1), and mixed with a sample mill at 15,000 rpm for 30 seconds to obtain an external addition toner (2).

External Addition Toner (3)

3% by weight of oil-treated silica particles and 1.5% by weight of the composite particle A are added to the toner particles (1), and mixed with a sample mill at 15,000 rpm for 30 seconds to obtain an external addition toner (3).

External Addition Toner (4)

3% by weight of oil-treated silica particles and 1.5% by weight of the composite particle B are added to the toner particles (1), and mixed with a sample mill at 15,000 rpm for 30 seconds to obtain an external addition toner (4).

External Addition Toner (5)

5% by weight of oil-treated silica particles and 0.5% by weight of the composite particle A are added to the toner particles (1), and mixed with a sample mill at 15,000 rpm for 30 seconds to obtain an external addition toner (5).

External Addition Toner (6)

5% by weight of oil-treated silica particles and 0.5% by weight of the composite particle D are added to the toner particles (1), and mixed with a sample mill at 15,000 rpm for 30 seconds to obtain an external addition toner (6).

External Addition Toner (7)

4% by weight of oil-treated silica particles and 0.5% by weight of the composite particle A are added to the toner particles (1), and mixed with a sample mill at 15,000 rpm for 30 seconds to obtain an external addition toner (7).

External Addition Toner (8)

5% by weight of oil-treated silica particles and 0.5% by weight of the composite particle B are added to the toner particles (1), and mixed with a sample mill at 15,000 rpm for 30 seconds to obtain an external addition toner (8).

External Addition Toner (9)

2.5% by weight of oil-treated silica particles and 1.5% by weight of the composite particle B are added to the toner particles (1), and mixed with a sample mill at 15,000 rpm for 30 seconds to obtain an external addition toner (9).

External Addition Toner (10)

2.5% by weight of oil-treated silica particles and 1.5% by weight of the composite particle E are added to the toner particles (1), and mixed with a sample mill at 15,000 rpm for 30 seconds to obtain an external addition toner (10).

External Addition Toner (11)

2.5% by weight of oil-treated silica particles and 1.5% by weight of the composite particle A are added to the toner particles (1), and mixed with a sample mill at 15,000 rpm for 30 seconds to obtain an external addition toner (11).

External Addition Toner (12)

3.0% by weight of oil-treated silica particles and 1.5% by weight of the composite particle A are added to the toner particles (1), and mixed with a sample mill at 15,000 rpm for 30 seconds to obtain an external addition toner (12).

External Addition Toner (13)

In the same manner as above, except that the oil-treated silica particles are replaced by hexamethyldisilazane-treated silica particles in the preparation of the external addition toner (1), an external addition toner (13) is obtained.

External Addition Toner (14)

In the same manner as above, except that the oil-treated silica particles are replaced by hexamethyldisilazane-treated silica particles in the preparation of the external addition toner (2), an external addition toner (14) is obtained.

External Addition Toner (15)

In the same manner as above, except that the oil-treated silica particles are replaced by hexamethyldisilazane-treated silica particles in the preparation of the external addition toner (3), an external addition toner (15) is obtained.

External Addition Toner (16)

In the same manner as above, except that the oil-treated silica particles are replaced by hexamethyldisilazane-treated silica particles in the preparation of the external addition toner (4), an external addition toner (16) is obtained.

External Addition Toner (17)

5.0% by weight of oil-treated silica particles and 0.5% by weight of the composite particle F are added to the toner particles (1), and mixed with a sample mill at 15,000 rpm for 30 seconds to obtain an external addition toner (17).

External Addition Toner (18)

4.0% by weight of oil-treated silica particles and 0.5% by weight of the composite particle B are added to the toner particles (1), and mixed with a sample mill at 15,000 rpm for 30 seconds to obtain an external addition toner (18).

External Addition Toner (19)

3.0% by weight of oil-treated silica particles and 1.5% by weight of the composite particle F are added to the toner particles (1), and mixed with a sample mill at 15,000 rpm for 30 seconds to obtain an external addition toner (19).

External Addition Toner (20)

2.5% by weight of oil-treated silica particles and 1.5% by weight of the composite particle F are added to the toner particles (1), and mixed with a sample mill at 15,000 rpm for 30 seconds to obtain an external addition toner (20).

Evaluation

Each of the external addition toner (1) through the external addition toner (20) thus obtained and a carrier are put into a V blender at a ratio of external addition toner:carrier=5:95 (weight ratio), and stirred for 20 minutes to obtain each of developers (1) to (20), and the developers are evaluated.

Furthermore, a carrier prepared as follows is used as the carrier.

Carrier 1,000 parts of Mn—Mg ferrite (volume average particle diameter: 50 μm, manufactured by Powdertech Co., Ltd., shape factor SF1: 120) is put into a kneader, and a solution prepared by dissolving 150 parts of a perfluorooctyl methyl acrylate-methyl methacrylate copolymer (polymerization ratio: 20/80, Tg: 72° C., weight average molecular weight: 72,000, manufactured by Soken Chemical & Engineering Co., Ltd.) in 700 parts of toluene is added thereto, and mixed at normal temperature for 20 minutes. Then, the mixture is heated to 70° C. and dried under reduced pressure, and taken out to obtain a coated carrier. Further, the coated carrier thus obtained is sieved through a 75 μm-mesh screen to remove coarse powder to obtain a carrier. The shape factor SF1 of the carrier is 122.

Evaluation of Fogging/Density Variation

A 700 Digital Color Press manufactured by Fuji Xerox Co., Ltd. including the obtained electrostatic charge image developer is left to stand for 3 days under a high temperature and high humidity environment (28° C./85%), and then an image having an area coverage of 1% is continuously printed on 100,000 sheets. Thereafter, using C2 paper manufactured by Fuji Xerox Co., Ltd., the image forming conditions are adjusted so as to give an image density in the range of 1.0 to 1.5, and print a patch of 5 cm×5 cm (density 1). Subsequently, after being left to stand for more 3 days under a high temperature and high humidity environment (28° C./85%), a patch of 5 cm×5 cm is printed again on one sheet under the same image forming conditions as those at the time of forming the patch for measurement of the density 1, and the image density is measured (density 2) Further, the image density is measured by an image densitometer X-RITE938 (manufactured by X-RITE Inc.).

Evaluation of Fogging

For the background portion on the $100{,}000^{th}$ sheet on which the image having an area coverage of 1% has been printed, the density is measured by an image densitometer X-RITE938 (manufactured by X-RITE Inc.), and evaluated in accordance with the following criteria.

A: The fogging density is less than 0.2 and partial fogging cannot be seen visually.

B: Although the fogging density is less than 0.2, slight fogging can be seen visually.

C: Although the fogging density is less than 0.2, partial fogging can be seen visually.

D: The fogging density is from 0.2 to less than 0.25.

E: The fogging density is equal to or more than 0.25.

Density Variation

The value of the A density represented by the following formula is calculated from the density 1 and the density 2, and evaluated in accordance with the following criteria.

Δ Density=|density 1−density 2|

A: 0<Δ Density 0.1

B: 0.1<Δ Density 0.2

D: 0.2<Δ Density

Evaluation of Color Streaks

A 700 Digital Color Press manufactured by Fuji Xerox Co., Ltd. equipped with the obtained electrostatic charge image developer is left to stand for 3 days under a low temperature and low humidity environment (10° C./10%), and then an image having an area coverage of 1% is continuously printed on 100,000 sheets.

Generation of color streaks on each of 99,900$^{th}$ to 100,000$^{th}$ sheets is observed visually, and evaluated in accordance with the following criteria.

A: No generation of color streaks

B: 0<Number of sheets having color streaks generated thereon≤5

C: 5<Number of sheets having color streaks generated thereon≤10

D: Number of sheets having color streaks generated thereon>10

The evaluation results of the respective Examples and Comparative Examples are summarized in Table 1.

TABLE 1

| | | Surface-oil-treated particles | Content (% by weight) of titania with respect to silica in the entire toner | Content ratio (atomic %) of titania with respect to silica on outermost surface of toner | Fogging | Color streaks | Density variation |
|---|---|---|---|---|---|---|---|
| Ex. 1 | Developer 1 | Present | 12 | 0.36 | B | A | A |
| Ex. 2 | Developer 2 | Present | 12 | 4.4 | B | A | B |
| Ex. 3 | Developer 3 | Present | 45 | 0.88 | A | B | A |
| Ex. 4 | Developer 4 | Present | 45 | 4.6 | A | B | B |
| Ex. 5 | Developer 5 | Present | 7 | 0.05 | D | A | A |
| Ex. 6 | Developer 6 | Present | 7 | 0.25 | C | A | A |
| Ex. 7 | Developer 7 | Present | 14 | 0.05 | C | A | A |
| Ex. 8 | Developer 8 | Present | 7 | 4.4 | C | A | B |
| Ex. 9 | Developer 9 | Present | 55 | 4.8 | C | C | B |
| Ex. 10 | Developer 10 | Present | 58 | 0.68 | D | C | B |
| Ex. 11 | Developer 11 | Present | 58 | 0.07 | D | C | B |
| Ex. 12 | Developer 12 | Present | 46 | 0.08 | C | C | B |
| Comp. Ex. 1 | Developer 13 | Absent | 12 | 0.36 | B | D | A |
| Comp. Ex. 2 | Developer 14 | Absent | 12 | 4.4 | B | D | A |
| Comp. Ex. 3 | Developer 15 | Absent | 45 | 0.88 | A | D | A |
| Comp. Ex. 4 | Developer 16 | Absent | 45 | 4.6 | A | D | A |
| Comp. Ex. 5 | Developer 17 | Present | 7 | 5.6 | C | A | D |
| Comp. Ex. 6 | Developer 18 | Present | 14 | 5.2 | B | A | D |
| Comp. Ex. 7 | Developer 19 | Present | 44 | 5.8 | B | C | D |
| Comp. Ex. 8 | Developer 20 | Present | 55 | 5.9 | C | C | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, comprising:

toner particles containing a colorant, a binder resin, and a release agent; and an external additive, wherein the external additive includes particles having oil-treated surfaces and composite particles having a titania core and a silica coating layer, the composite particles having a volume average primary particle diameter in a range of from 60 nm to 500 nm, and the toner has a content ratio of titania with respect to silica on a surface of the toner particles, as measured by X-ray photoelectron spectroscopy, of equal to or less than 5 atomic %.

2. The electrostatic charge image developing toner according to claim 1, wherein a content of titania with respect to silica in the entire toner is in a range of 10% by weight to 50% by weight.

3. The electrostatic charge image developing toner according to claim 1, wherein the content ratio of titania with respect to silica on the surface of the toner particles is in a range of 0.1 atomic % to 5 atomic %.

4. The electrostatic charge image developing toner according to claim 1, wherein a weight ratio of the particles having oil-treated surfaces to the composite particles having a titania core and a silica coating layer is in a range of 10:1 to 1:10.

5. The electrostatic charge image developing toner according to claim 1, wherein a weight ratio of the particles having oil-treated surfaces to the composite particles having a titania core and a silica coating layer is in a range of 5:1 to 1:5.

6. The electrostatic charge image developing toner according to claim 1, wherein the oil is selected from a silicone oil, an aliphatic amide, and a wax.

7. The electrostatic charge image developing toner according to claim 1, wherein a volume average primary particle diameter of the particles having oil-treated surfaces is in a range of 3 nm to 500 nm.

8. An electrostatic charge image developer comprising:

the toner according to claim 1; and a carrier.

9. The electrostatic charge image developer according to claim 8, wherein the toner has a weight ratio of the particles having oil-treated surfaces to the composite particles having a titania core and a silica coating layer in a range of 10:1 to 1:10.

10. A toner cartridge, comprising:

a toner containing chamber that contains the electrostatic charge image developing toner according to claim 1.

11. A developer cartridge, comprising:

a developer containing chamber that contains the electrostatic charge image developer according to claim 8.

12. A process cartridge for an image forming apparatus comprising:

a developer holding member that holds and transports an electrostatic charge image developer, wherein the developer is the electrostatic charge image developer according to claim 8.

13. The process cartridge for an image forming apparatus according to claim 12, wherein the toner has a weight ratio of the particles having oil-treated surfaces to the composite particles having a titania core and a silica coating layer in a range of 10:1 to 1:10.

14. An image forming apparatus comprising:

an image holding member;

a charging unit that charges a surface of the image holding member;

an electrostatic latent image forming unit that forms an electrostatic latent image on the surface of the image holding member;

a development unit that contains the electrostatic charge image developer according to claim 8, and develops the electrostatic latent image formed on the surface of the image holding member using the developer to form a toner image; and a transfer unit that transfers the formed toner image onto a recording member.

15. The image forming apparatus according to claim 14, wherein the toner has a weight ratio of the particles having oil-treated surfaces to the composite particles having a titania core and a silica coating layer in a range of 10:1 to 1:10.

16. An image forming method comprising:

charging a surface of an image holding member;

forming an electrostatic latent image on the surface of the image holding member;

developing the electrostatic latent image formed on the surface of the image holding member using the electrostatic charge image developer according to claim 8 to form a toner image; and transferring the formed toner image onto a recording member.

17. The image forming method according to claim 16, wherein the toner has a weight ratio of the particles having oil-treated surfaces to the composite particles having a titania core and a silica coating layer in a range of 10:1 to 1:10.

18. The electrostatic charge image developing toner according to claim 1, wherein a treatment amount of oil is equal to or more than 0.16% by weight with respect to a total weight of the toner.

* * * * *